United States Patent [19]

Wang et al.

[11] Patent Number: 5,040,319

[45] Date of Patent: Aug. 20, 1991

[54] SOUND SENSITIVE TOY ASSEMBLY INCLUDING RECIPROCATING MECHANISM

[75] Inventors: Kuang C. Wang; Arthur Y. P. Wang, both of Taichung, Taiwan

[73] Assignee: Metro Toy Industrial Co., Ltd., Taichung, Taiwan

[21] Appl. No.: 518,945

[22] Filed: May 4, 1990

[51] Int. Cl.[5] ..... G09F 19/08

[52] U.S. Cl. ..... 40/414; 40/418; 40/442; 446/83; 446/358; 446/367; 446/175

[58] Field of Search ..... 40/411, 414–420, 40/421, 423, 429, 442, 457; 446/175, 331, 357, 358, 366, 367; 381/150; 318/16; 367/197–199

[56] References Cited

U.S. PATENT DOCUMENTS

| | | | |
|---|---|---|---|
| 1,048,397 | 12/1912 | Earl | 446/352 |
| 1,452,820 | 4/1923 | Whitcomb et al. | 446/331 |
| 1,527,904 | 2/1925 | Water | 40/418 |
| 1,641,914 | 9/1927 | Boillot | 40/442 |
| 2,009,337 | 7/1935 | Brewer | 446/83 |
| 2,307,296 | 1/1943 | Peyton | 446/83 |
| 2,603,912 | 7/1952 | Gruber | 446/302 |
| 2,700,250 | 1/1955 | Williams | 416/338 |
| 3,643,374 | 2/1972 | Gunther et al. | 446/359 |
| 4,139,968 | 2/1979 | Milner | 446/175 |
| 4,169,335 | 10/1979 | Betancourt | 446/357 |
| 4,804,348 | 2/1989 | Bondi | 446/83 |
| 4,889,027 | 12/1989 | Yokoi | 446/175 |
| 4,890,828 | 1/1990 | Hou | 40/428 |
| 4,903,424 | 2/1990 | Satoh et al. | 40/414 |

FOREIGN PATENT DOCUMENTS 2486807 1/1982 Fed. Rep. of Germany ..... 446/303

*Primary Examiner*—Kenneth J. Dorner
*Assistant Examiner*—James M. Gardner
*Attorney, Agent, or Firm*—Silverman, Cass & Singer, Ltd.

[57] ABSTRACT

A toy band assembly including a stage assembly, a plurality of movable toy figures, such as toy frog figures, a plurality of toy musical instruments, a sound pick-up unit, a stage lights assembly, power supply, a power supply switch, an integrated circuit, a front transmission mechanism, a front reciprocating mechanism, a rear transmission mechanism, and a rear reciprocating mechanism. When the power supply switch is switched on, light bulbs in a stage lights assembly start to flash and the sound pick-up unit picks up sound signals from the surroundings and directs electric signals to the integrated circuit. The integrated circuit electrically connects the power supply means to a front and a rear motor when sufficient electrical signal is received. The front and rear motors rotate and translate their rotations to the front and rear transmission mechanisms and to the front and rear reciprocating mechanisms. The plurality of toy figures is mechanically connected to the front and rear reciprocating mechanism and correspondingly moves left and right, up and down. The mouths and heads of the plurality of toy figures are capable of movement, thus giving an impression that the toy figures are performing before an audience.

15 Claims, 12 Drawing Sheets

SOUND SENSITIVE TOY ASSEMBLY INCLUDING RECIPROCATING MECHANISM

BACKGROUND OF THE INVENTION

This invention relates generally to a movable toy assembly with a sound detecting device, and more particularly, to a toy adapted to be activated for movement by sounds received by an electroacoustic transducer or condenser microphone whose electric signal output controls the speed of movement of the toy assembly.

SUMMARY OF THE INVENTION

The present invention provides a toy assembly which receives sound signals from the surroundings, the strength and frequency of which determines the speed of movement of a plurality of toy figures positioned on the toy assembly.

The toy assembly constructed according to the invention is characterized by a stage assembly having a first portion and a second elevated portion, three toy figures such as frogs or the like mounted to the first portion of the stage assembly, two toy figures, a toy keyboard instrument, and a toy percussion instrument, mounted to the second portion of the stage assembly, a sound pick-up and stage lights assembly similarly mounted to the second portion of the stage assembly, a toy microphone assembly mounted at the first portion of the stage assembly and movably controlled by one of the toy figures, power supply means projecting inwardly from a bottom face of the stage assembly, a power supply switch for the power supply, an integrated circuit mounted on a printed circuit board inside the stage assembly and electrically connected to an electrostatic condenser microphone of the sound pick-up and stage lights assembly, the power supply means, and to a front and a rear motor, a front transmission mechanism contained by a gear casing, the front transmission mechanism including, an actuating axle having a first and a second gear wheel, the first gear wheel being rotatably engaged to the front motor, an assisting axle having a first and a second gear wheel, the first gear wheel being rotatably engaged to the second gear wheel of the actuating axle, a transport axle having a gear wheel rotatably engaged to the second gear wheel of the assisting axle, two ends of the transport axle having curving eccentric wheels, a front reciprocating mechanism including, three slots and screw posts formed on the first portion of the stage assembly, a pair of mounting units, each having a transverse through-hole and being oppositely disposed on each slot, three slot covers, each having a central receiving hole and hook members for mounting at the slots, three biasing members having one end connected to the screw post, three movement posts having one end formed with mounting posts received by the transverse through-holes, a central section connected to a second end of the biasing member, and a second end movably connected to the eccentric wheels of the front transmission mechanism, a rear transmission mechanism having a structure similar to that of the front transmission mechanism, the main differences lying in that the rear transmission mechanism has a longer transport axle and has eccentric wheels which are substantially more circular, and a rear reciprocating mechanism which includes a pair of pipe members formed on the second portion of the stage assembly, the pipe members receiving mounting supports of two toy figures which are pushed up by the eccentric wheels of the rear transmission mechanism.

When the power switch is switched on light bulbs provided in the sound pick-up and stage lights assembly start to flash. The transducer detects sound signals and directs electric signals to the integrated circuit. The integrated circuit electrically connects the cell means to the front and rear motor when there is a sufficient electrical signal generated by the transducer. The front and rear motors rotate and translate their rotations to the front and rear transmission mechanisms and to the front and rear reciprocating mechanisms. The toy figures are mechanically connected to the front and rear reciprocating mechanisms, the movement of which allows the toy figures to move left and right, up and down, in a rocking manner. The mouths and heads of the toy figures are movable, thus giving the impression that the toy figures are actually performing before an audience.

Other features and advantages of this invention will become apparent from the following detailed description of the preferred embodiment with reference to the accompanying drawing.

DESCRIPTION OF THE PREFERRED EMBODIMENT

Figure 1:
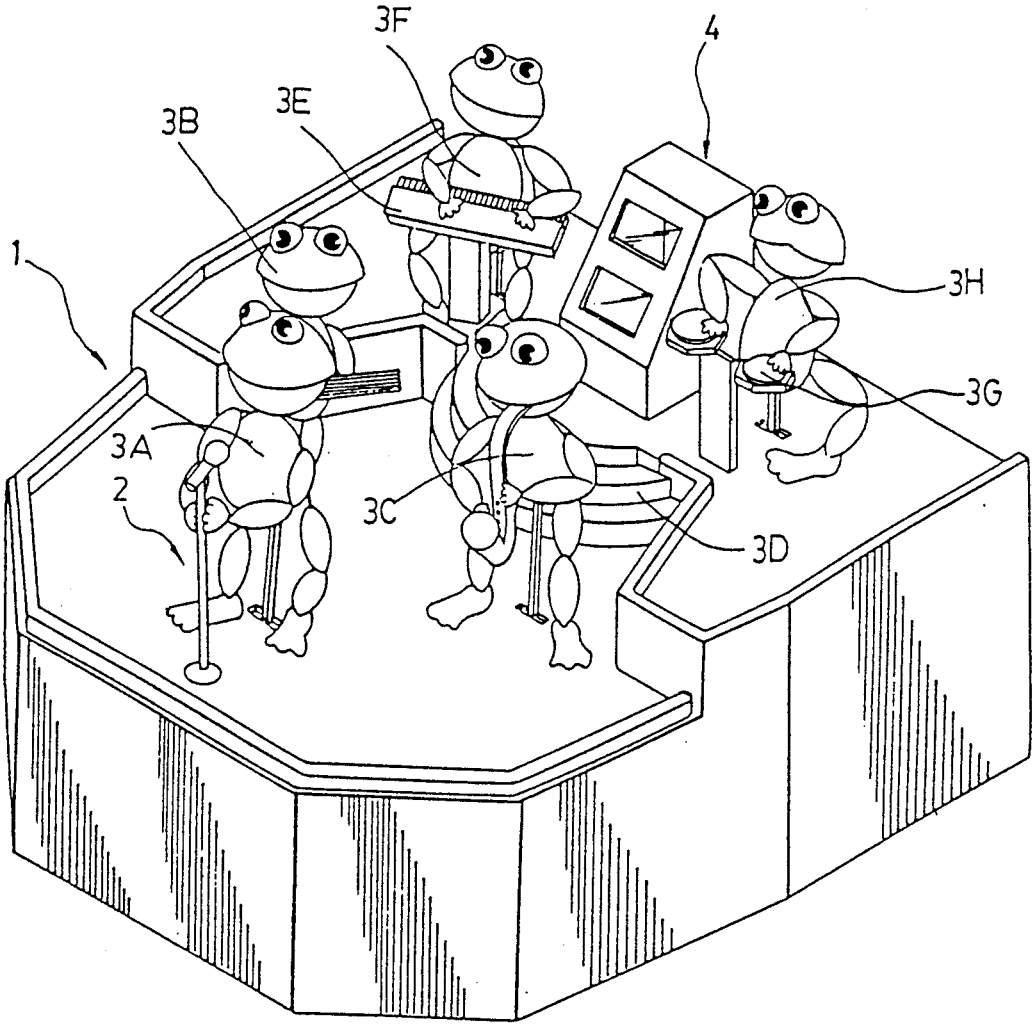
FIG. 1 is a perspective view of the toy assembly of the invention.

Referring to FIG. 1, the toy assembly constructed according to this invention includes a stage assembly formed as a hollow closed body having a top face with eight sides. A toy microphone assembly 2 is mounted at a top front portion of the stage assembly 1. A plurality of toy figures such as frogs 3 including a first toy frog 3A is mounted at a top face of the stage assembly 1 and positioned at the immediate rear of the toy microphone assembly 2. A second toy frog 3B, similarly is mounted to the top face of the stage assembly 1 and positioned at the left rear of the first toy frog 3A, the second toy frog 3B holding a toy string instrument A third toy frog 3C, similarly is mounted to the top face of the stage assembly 1 and positioned to the right of the second toy frog 3B, the third toy frog 3C holding a toy wind instrument.

The stage assembly 1 includes an elevated platform with vertical walls that form a substantially trapezoidal recess. A plurality of semicircular stair steps 3D is formed on a central portion of the trapezoidal recess. A fourth toy frog 3F, mounted at a left side of the elevated platform, is at the immediate rear of a toy keyboard instrument 3E similarly mounted to the same. A fifth toy frog 3H, mounted at a right side of the elevated platform, is at the immediate rear of a toy percussion instrument 3G similarly mounted to the elevated platform. A sound pick-up and stage lights assembly 4, mounted to the elevated platform between the fourth and fifth toy frogs 3F, 3H, includes a flashing light output.

Figure 2B:
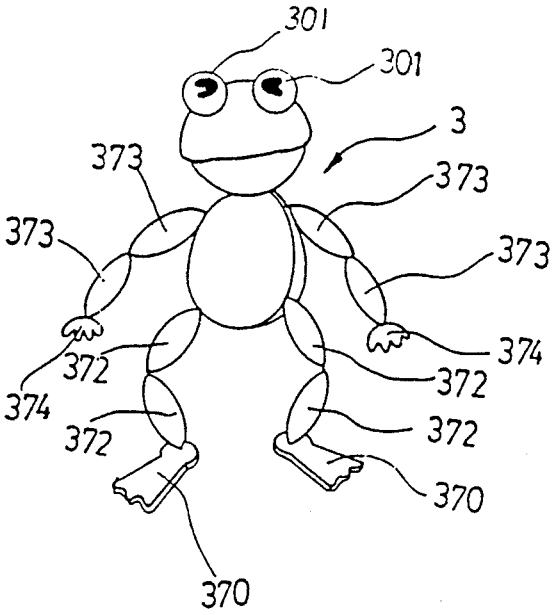
FIG. 2(B) is an assembled view of the toy frog figure shown in FIG. 2(A)
Figure 2A:
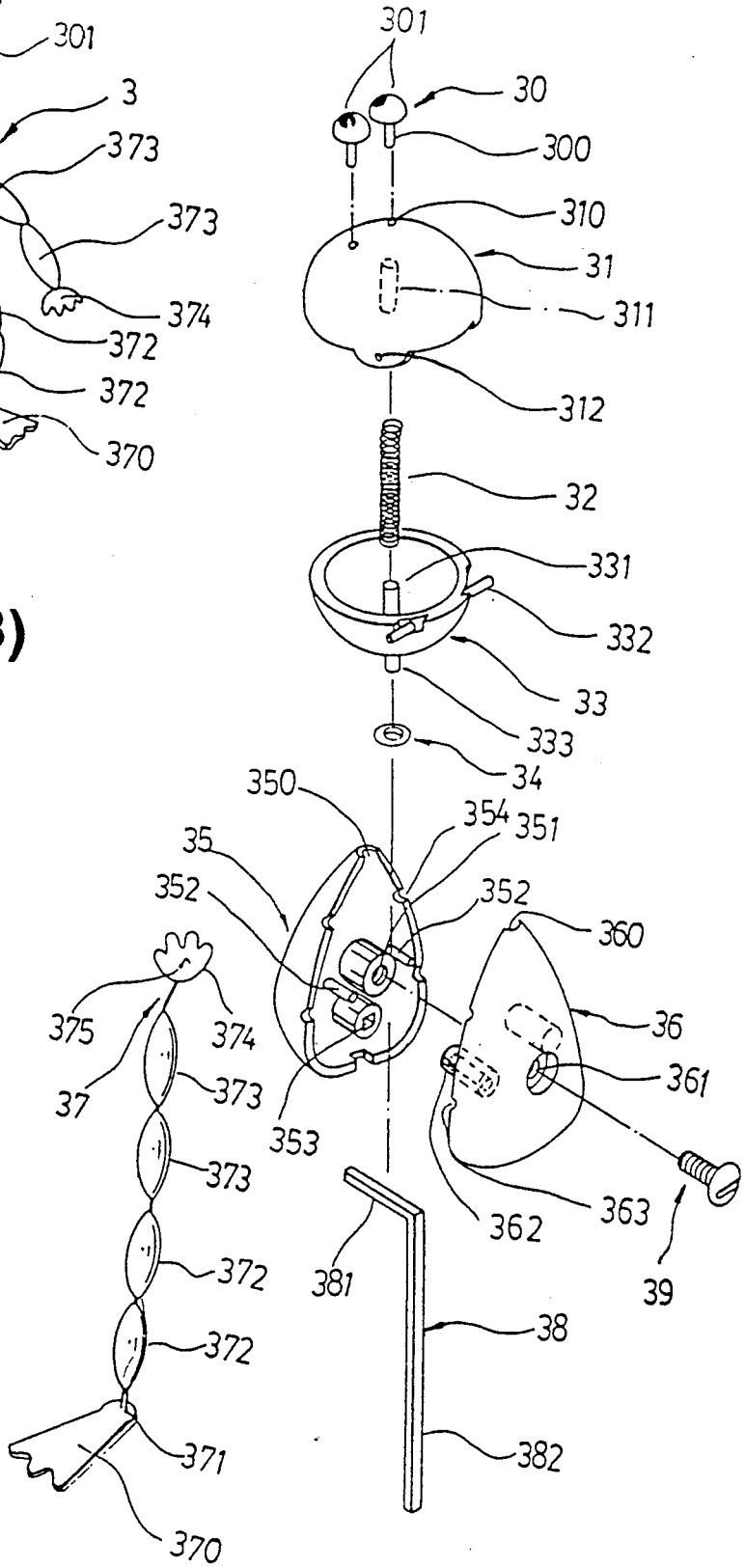
FIG. 2(A) is an exploded view of a toy frog figure constructed to the invention.

Referring to FIGS. 2(A) and 2(B), the toy frog 3 constructed according to the invention includes a pair of eyeballs 30, an upper head frame 31, a spring member 32, a lower head frame 33, a fastening ring 34, a front body frame 35, a rear body frame 36, a pair of threaded bead members 37, a mounting support 38, and a screw member 39.

Each of the eyeballs 30 is hemispherical in shape and has a rod member 300 projecting axially downwardly from a flat bottom surface of the same, and an eye pupil 301 printed on the convex surface of the same.

The upper head frame 31 is formed as a hemispherical hollow body with a pair of eye holes 310 for receiving the rod members 300. A mounting post 311 projects axially downwardly from a central portion of the upper head frame 31. A head connecting hole 312 is formed at each of a pair of lip-like curving projections oppositely disposed at the peripheral edge of the upper head frame 31. The pair of lip-like curving projections of the upper head frame 31 serve as ears for the toy frog 3.

A lower head frame 33 is formed as a hemispherical hollow body that complements the upper head frame 31. A mounting post 311 formed in upper head frame 31 and a lower mounting post 333 formed in lower head frame 33 axially projects from a central portion of the lower head frame 33. The spring member 32 is connected to the mounting post 311 of the upper head frame 31 and to the mounting post 331 of the lower head frame 33. The fastening ring 34 is tightly sleeved to the another mounting post 333. A head connecting rod 332 extends transverse to the mounting posts 331, 333, and has two ends inserted into the head connecting holes 312 of the upper head frame 31. The upper and lower head frames 31, 33 are thereby hinged together, and a mouth adapted to be opened is formed in the head portion.

The front body frame 35 is formed as a hollow half-shell body having a substantially converging top end 350. A threaded screw receiving post 351 projects inwardly from the center of the front body frame 35. A pair of oppositely disposed body connecting poles 352 is formed adjacent to the screw receiving post 351. A support receiving member 353 is formed beneath the screw receiving post 351. Four thread notches 354 are formed on the peripheral edge of the front body frame 35. A rectangular notch is formed at the bottom end of the same.

The rear body frame 36 is formed as a hollow body having a shape that complements the front body frame 35. The rear body frame 36 has a substantially converging top end 360. A screw receiving portion 361 is formed at the center of the rear body frame 36. A pair of pole receiving members 362 is formed adjacent to the screw receiving portion 36 and receives the body connecting poles 352 of the front body frame 35. As with the front body frame 35, four thread notches 363 are formed at the peripheral edge of the rear body frame 36 above and below the pole receiving members 362. A rectangular notch is formed at the bottom end of the rear body frame 36.

A pair of threaded bead members 37 are used as the arms and legs of the toy frog 3. Each of the threaded bead members 37 includes a foot portion 370 having a pair of threaded holes 371, a pair of leg limbs 372, each having an axial central hole, a pair of arm limbs 373, each similarly having an axial central hole, and a hand portion 374 having a pair of thread holes 375. A thread member passes through the thread holes 375 of the hand portion 374, the central holes of the arm limbs 373, the central holes of the leg limbs 372 and the thread holes 371 of the foot portion 370 in that order. The foot portion 370 is separated from the hand portion 374 by a predetermined length of thread. The two ends of the thread member are knotted together at the foot portion 370.

The mounting support 38 comprises a pole-shaped body having a first segment 381 folded 90 degrees with respect to a second segment 382. The length of the first segment 381 is shorter than the length of the second segment 382. The first segment 381 is received by the support receiving member 353 of the front body frame 35. When the front body frame 35 is assembled to the rear body frame 36, the second segment 382 of the mounting support 38 projects out of the front and rear body frames 35, 36 at the rectangular notches of the same.

A screw member 39 fastens the front body frame 35 to a rear body frame 36. The screw member 39 has a screw head received by the screw receiving portion 361 of the rear body frame 36, and a screw body received by the screw receiving post 351 of the front body frame 35.

Figure 2C:
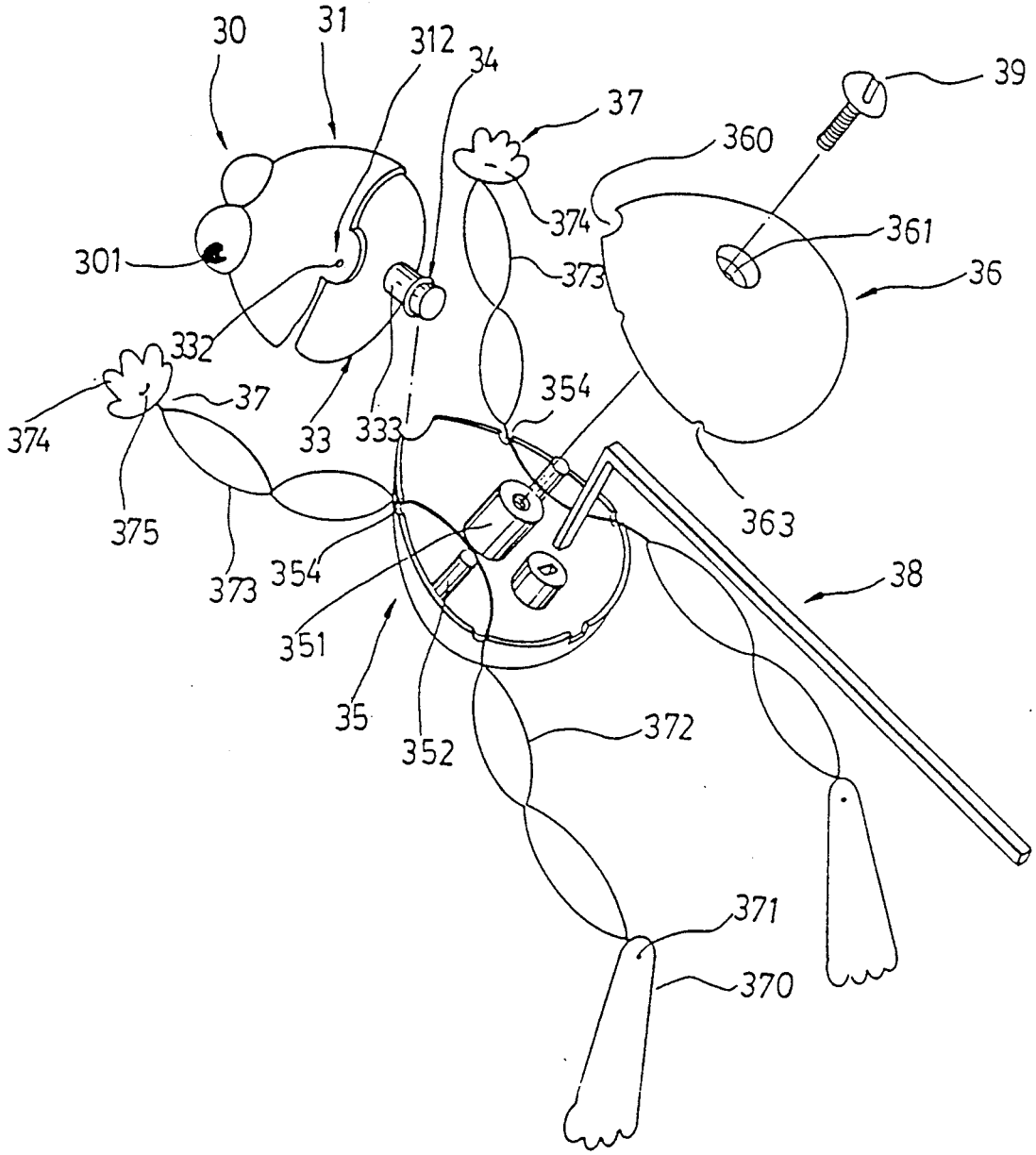
FIG. 2(C) is an enlarged exploded view of the toy frog figure according to the invention.

FIG. 2(C) illustrates the assembly of the toy frog 3. The rod members 300 of the eyeballs 30 are received by the eye holes 310 of the upper head frame 31. The spring member 32 has a first end surrounding the mounting post 311 of the upper head frame 31 and a second end surrounding the mounting post 331 of the lower head frame 33. The two ends of the head connecting rod 332 are received by the head connecting holes 312 of the upper head frame 31. The fastening ring 34 is sleeved near an extreme end of the lower mounting post 333. An excess length of thread of the threaded bead members 37 is disposed between the screw receiving post 351 and the body connecting poles 352 of the front body frame 35. The excess length of thread may be wound over the body connecting poles 352 if desired. The arm limbs 373 are separated from the leg limbs 372 at the thread notches 354, 363 of the front and rear body frames 35, 36. The first segment 381 of the mounting support 38 is received by the support receiving member 353 of the front body frame 35. The second segment 382 of the mounting support 38 projects out of the front and rear body frames 35, 36 at the rectangular notches of the same. The lower mounting post 333 and the fastening ring 34 are received at a through-hole formed by the converging top ends 350, 360 of the front and rear body frames 35, 36. When assembled, the fastening ring 34 prevents the disengagement of the head portion from the front and rear body frames 35, 36. The screw member 39 is received by the screw receiving portion 361 of the rear body frame 36 and the screw receiving post 351 of the front body frame 35.

Figure 3:
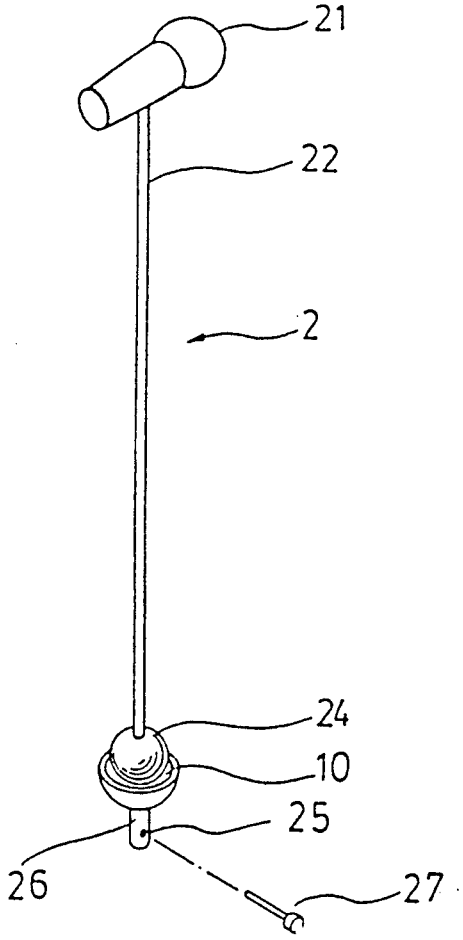
FIG. 3 is a perspective view of the toy microphone assembly according to the invention.

Referring to FIG. 3, the toy microphone assembly 2 constructed according to the invention includes a microphone body having a microphone head 21, a microphone stand 22, and a ball-shaped portion 24 connected to one end of the microphone stand 22. A section 26 of the microphone stand 22 protrudes through the ball-shaped portion 24 and has a through-hole 25 formed therein. The ball-shaped portion 24 rests on a concave ball receiving portion 10 formed on the top face of the stage assembly 1. The protruding section 26 of the microphone stand 22 projects inside the stage assembly 1 through a central hole 101 formed on the concave receiving portion 10 (see FIGS. 6 and 10.) An aluminum pin 27 passes through the through-hole 25 and has one end hooked to the protruding section 26. The aluminum pin 27 prevents the microphone assembly 2 from disengaging from the stage assembly 1. The hand portions 374 of the first toy frog 3A are attached to the microphone stand 22. Movement of the first toy frog 3A will correspondingly move the microphone assembly 2.

Figure 4:
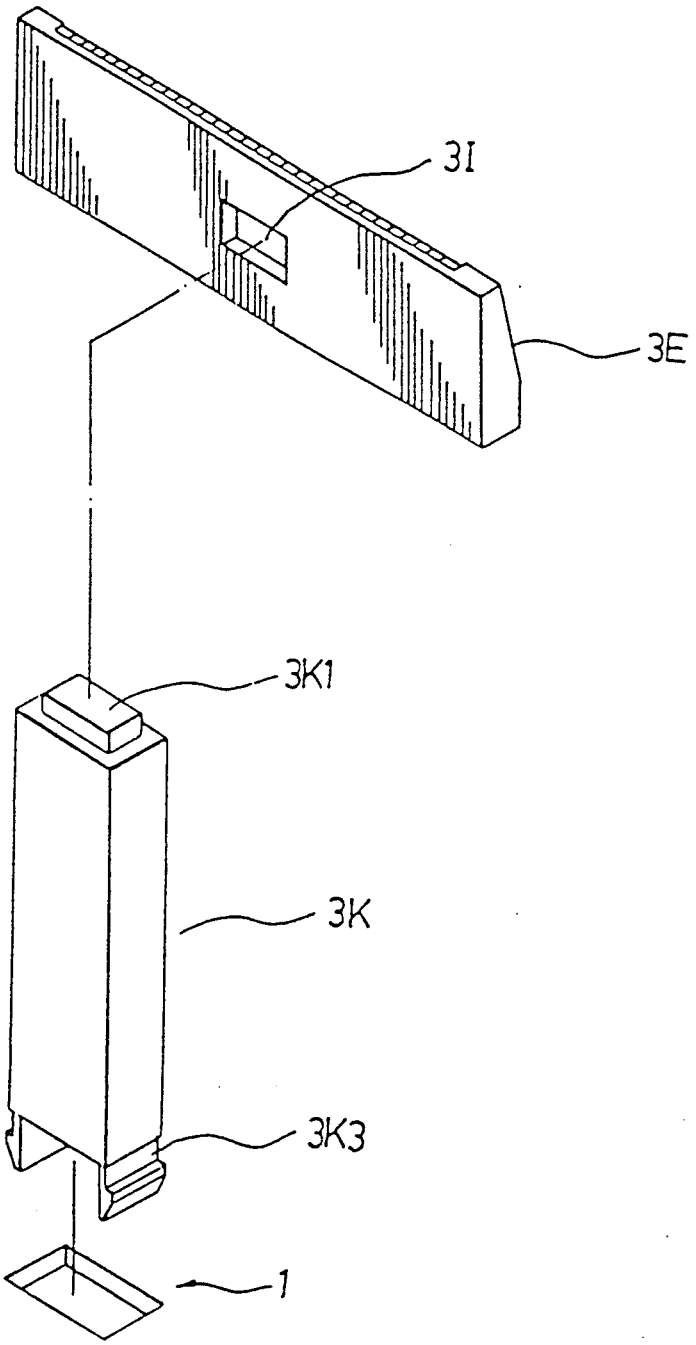
FIG. 4 is an exploded view of the toy keyboard instrument according to the invention.

FIG. 4 illustrates the manner of assembly of the toy keyboard instrument 3E with the stage assembly 1. The keyboard instrument 3E has a rectangular mounting hole 3I. A keyboard stand 3K has a rectangular projection 3K1 formed on a first end and is received by the mounting hole 3I. A pair of oppositely disposed symmetrical hook members 3K3 is formed on a second end of the keyboard stand 3K. The hook members 3K3 are made of an elastic material and can be fitted inside a rectangular hole formed on the top face of the stage assembly 1.

The toy percussion instrument 3G includes a structure similar to that of the keyboard instrument 3E and is mounted to the top face of the stage assembly 1 in a similar fashion. The main difference is that the keyboard instrument 3E is replaced by the percussion instrument 3G.

Figure 5A:
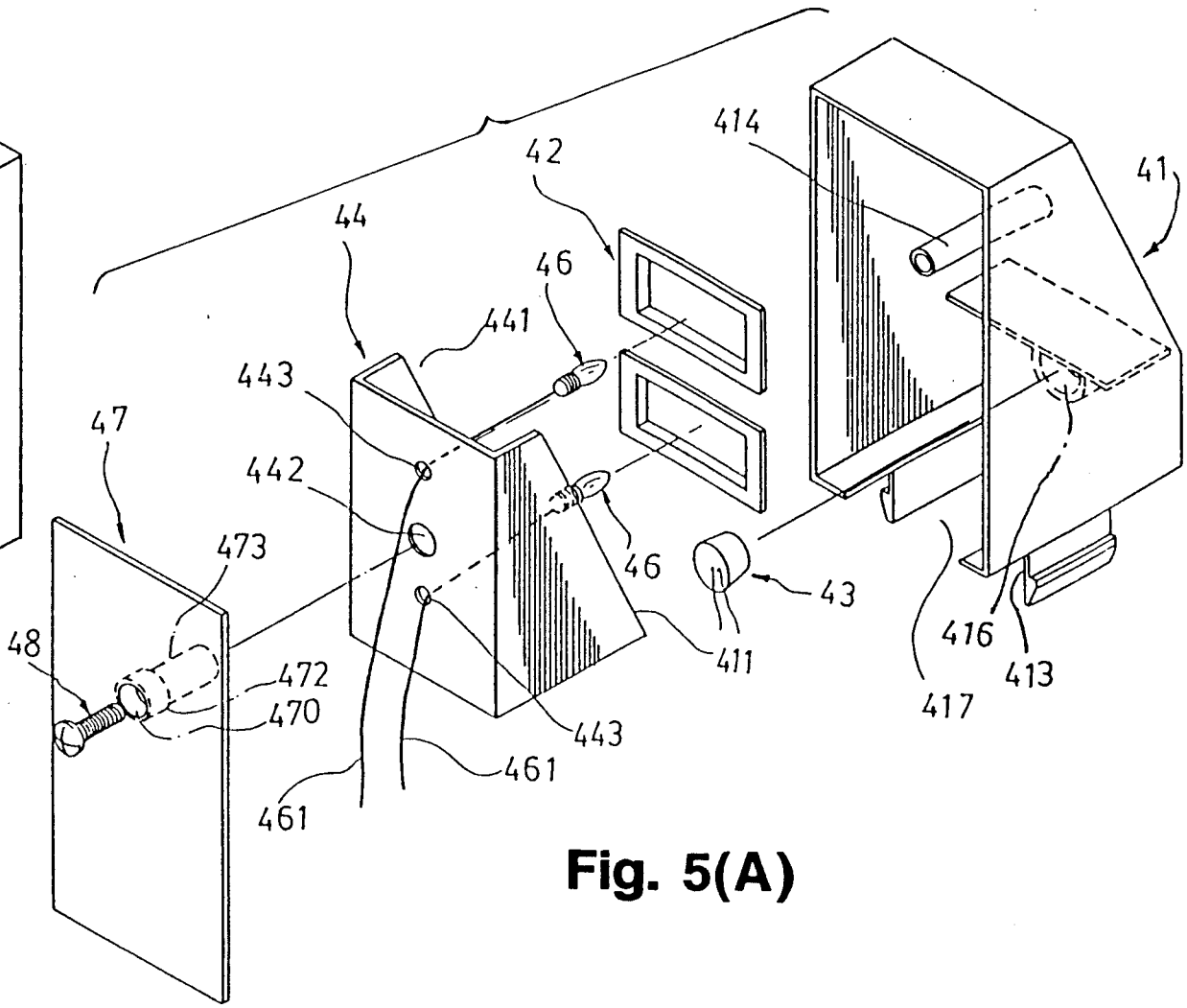
FIG. 5(A) is an exploded view of the sound pick-up and stage lights assembly constructed according to the invention.
Figure 5B:
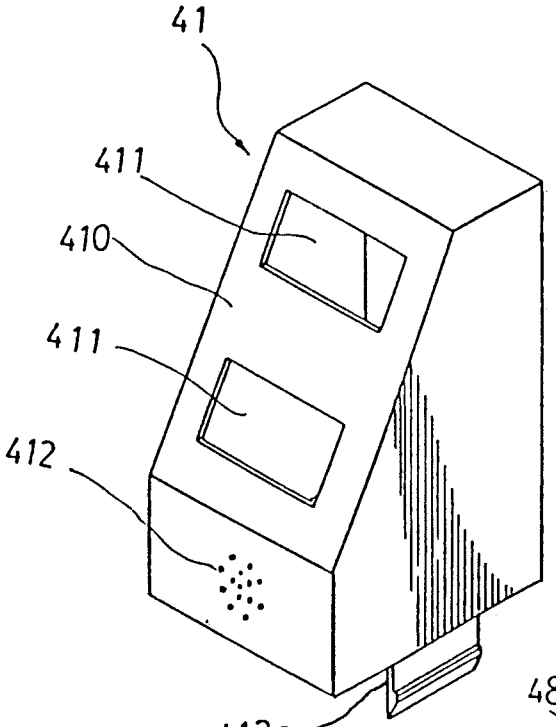
FIG. 5(B) front perspective view of the front casing of the and stage lights assembly.

Referring to FIGS. 5(A) and 5(B), the sound pick-up and stage lights assembly 4 constructed according to the invention includes a first casing 41, two windows 42, an electroacoustic transducer 43, a second casing 44, two light bulbs 46, a third casing 47, and a screw member 48.

The first casing 41 is formed as a plastic hollow body having a cross section in the general form of an irregular pentagon. An inclined face 410 has a pair of window openings 411. A plurality of sound holes 412 is formed on a second face adjacent to the inclined face 410. A bottom face of the first casing 41 has oppositely disposed symmetrical hook members 413 formed therein. A threaded screw receiving post 414 inwardly projects from the center of the inclined face 41 between the window openings 411. A transducer receiving frame 416 is formed on the second face for holding the transducer 43 in place. The first casing 41 further comprises an opening 417 formed on the bottom face.

Each of the windows 42 has a glass surface and is attached to the frame of the first casing 41 at the window openings 41.

The transducer 43 is held in place by the transducer receiving frame 416 and directly faces the sound holes 412.

The second casing 44 has a pair of trapezoidal walls 441 disposed opposite to each other and corresponding to the inclined face 410 of the first casing 41. A central hole 442 is formed on a wall adjacent to the trapezoidal walls 441. A pair of mounting holes 443, each having a diameter smaller than that of the central hole 442, is formed above and below the central hole 442.

Each of the light bulbs 46 has a conducting wire 461 and a rear portion received by the mounting holes 443 of the second casing 44.

The third casing 47 has a transverse pipe member 470 which forms a through-hole with the same. The pipe member 470 has an annular step shoulder dividing the pipe member 470 into two segments. There is a first segment 472 having a diameter larger than that of the second segment 473. The second segment 473 passes through the central hole 442 of the second casing 44. The first segment 473 prevents the third casing 47 from tightly pressing against the second casing 44 to avoid damage to the conducting wires 461 of the light bulbs 46.

During assembly, the screw member 48 passes through the pipe member 470 of the third casing 47 and the central hole 442 of the second casing 44. The windows 42 are in contact with the inclined side Of the trapezoidal walls 441. The light bulbs 46 are coincident with the central portion of the windows 42. When the transducer 43 is in place, the screw member 48 is received by the screw receiving post 414 of the first casing 41. The conducting wires 461 extend through the opening 417 of the first casing 41. The assembled sound pick-up and stage lights assembly 4 is mounted to the stage assembly 1 by the hook members 413.

Figure 6A:
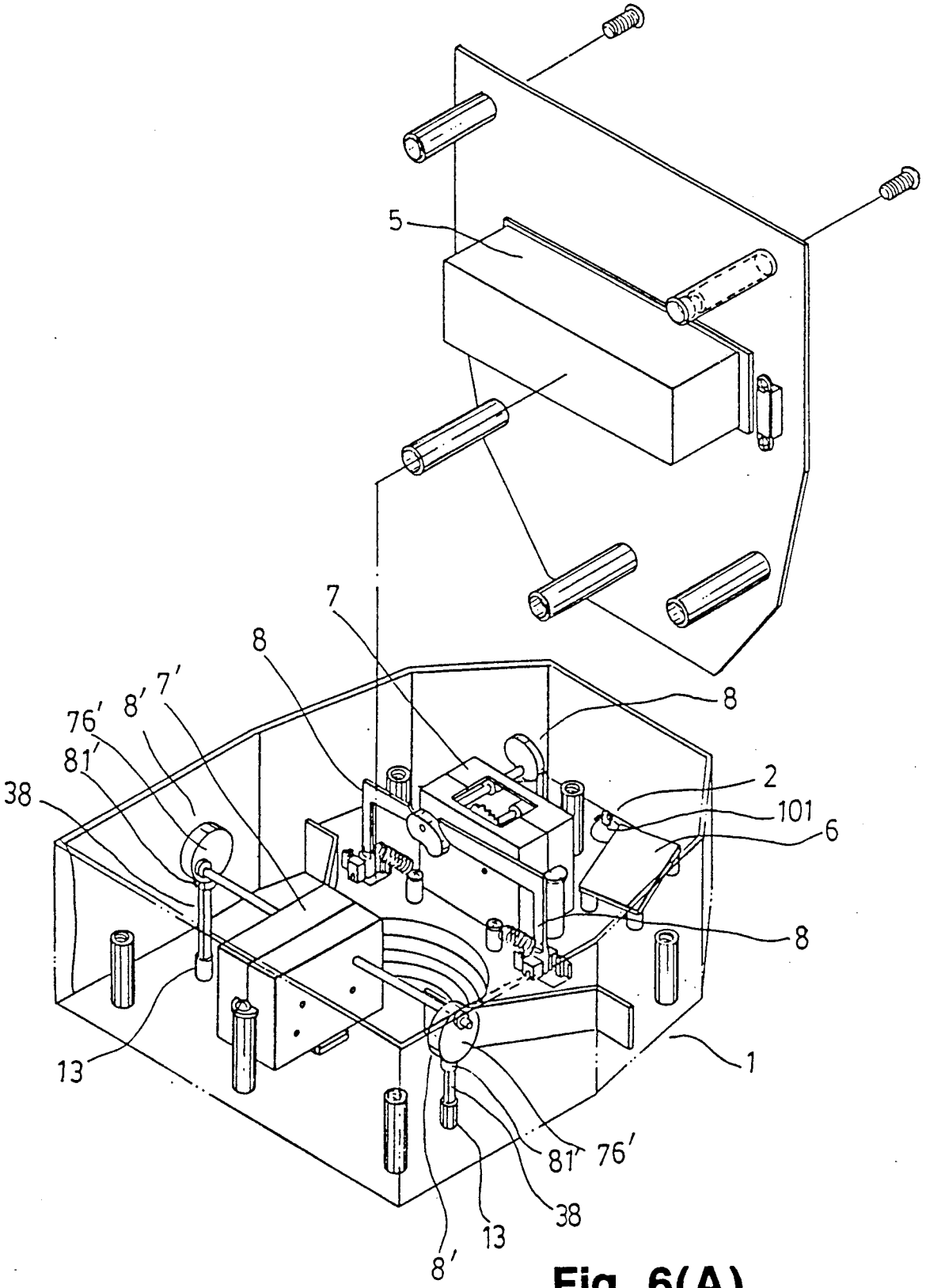
FIG. 6(A) is a bottom perspective view of the stage assembly of the in with the base cover thereof attached.

Referring to FIG. 6(A), a perspective view of the stage assembly 1 is an inverted position and with the bottom face detached shows the preferred embodiment to further include a power supply or cell means 5, an integrated circuit 6, a first transmission mechanism 7, a front reciprocating mechanism 8, a rear transmission mechanism 7', and a rear reciprocating mechanism 8'.

Figure 6B:
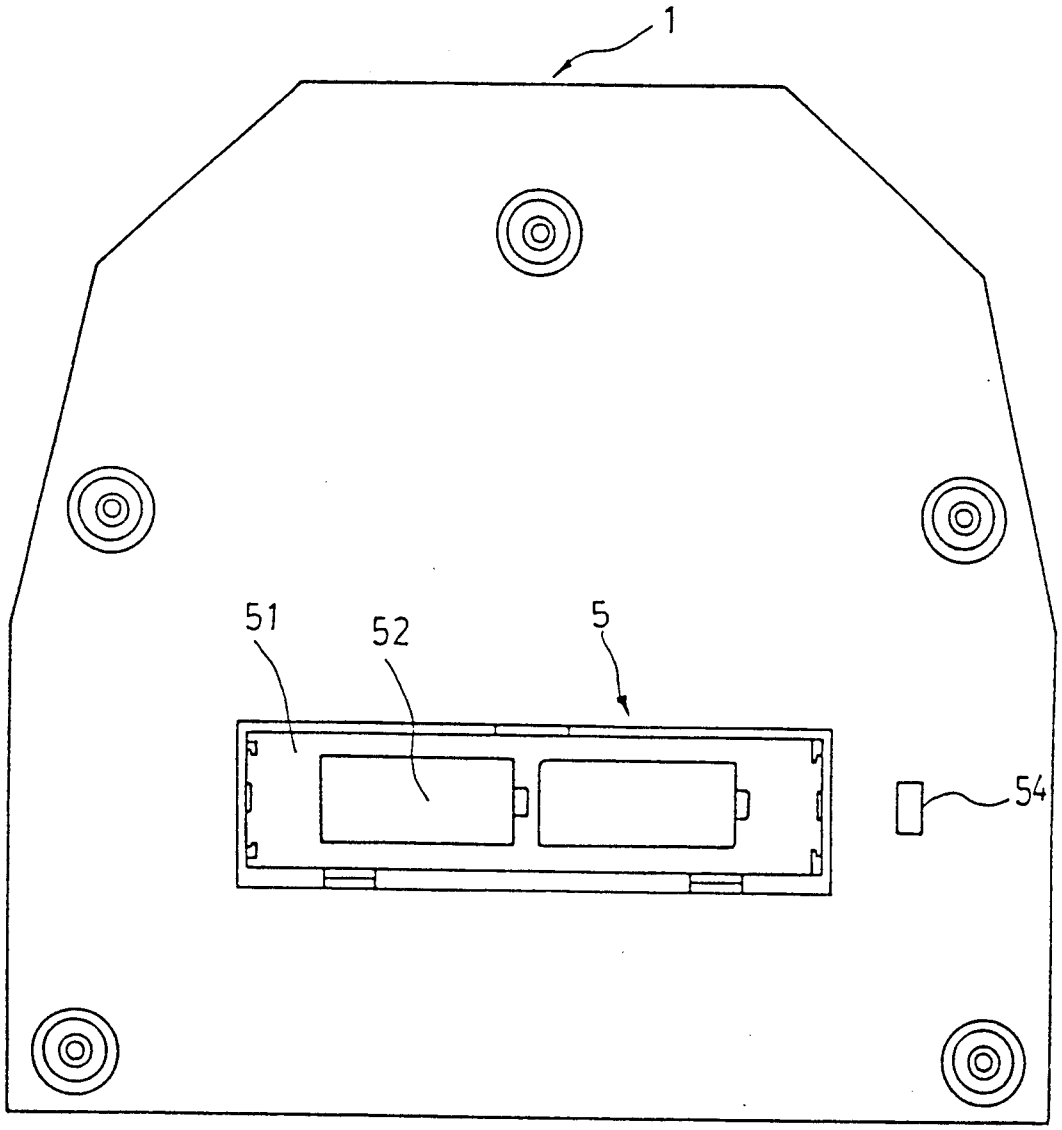
FIG. 6(B) is a bottom plan view of the base cover member of the assembly.

Referring to FIG. 6(B), the cell means 5 has a cell receiving space 51 for receiving battery cells 52. The cell means 5 projects inwardly from the bottom face of the stage assembly 1. A power supply switch 54 is electrically connected to the cell means 5.

Figure 7:
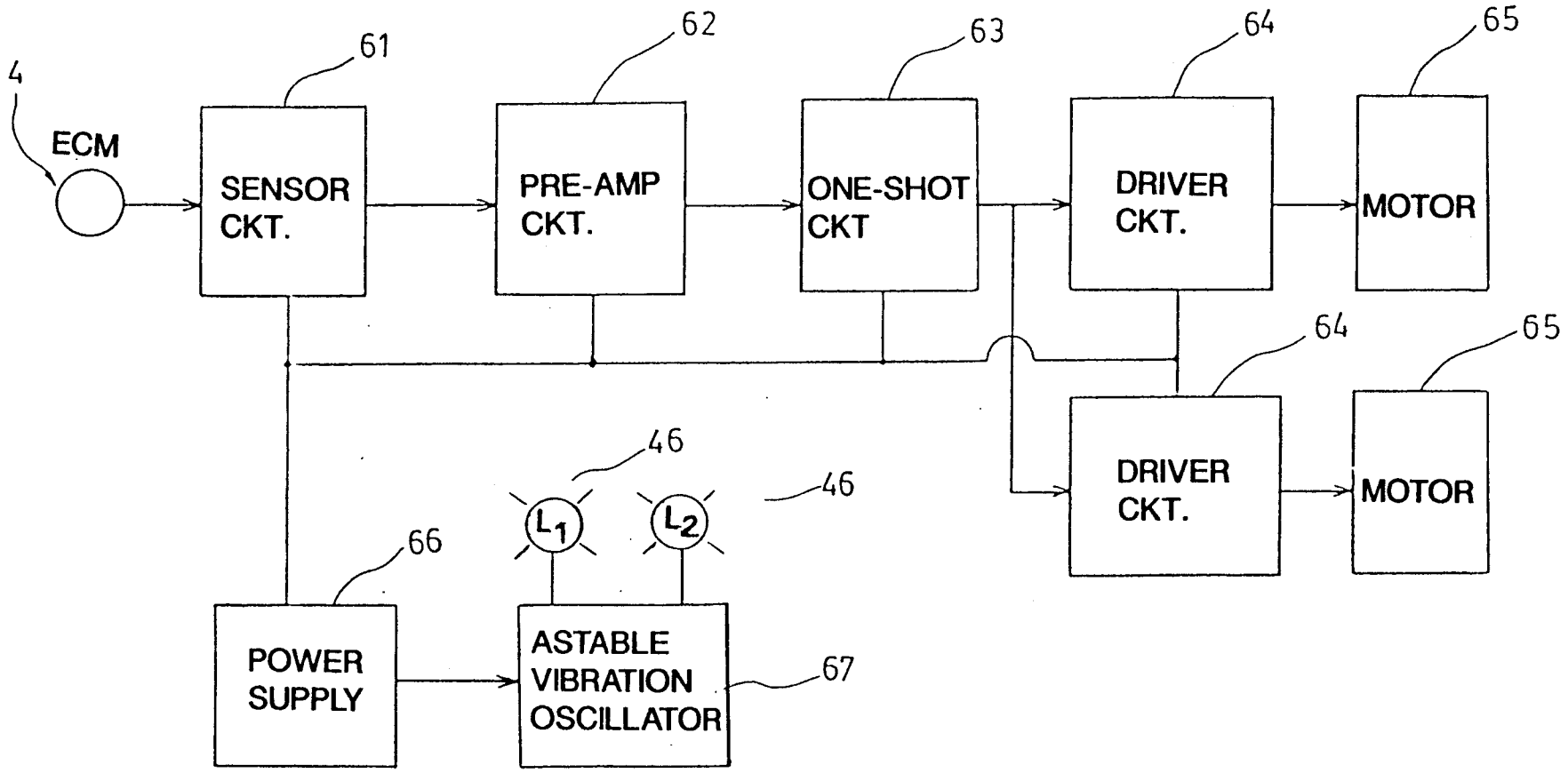
FIG. 7 a schematic circuit block diagram of the integrated of the invention.

A schematic circuit block diagram of the integrated circuit 6 of the invention is shown in FIG. 7. The output of the transducer 4, which is an electrostatic condenser microphone, is fed into a sensor circuit 61. The output of the sensor circuit 61 is amplified by a pre-amplifier circuit 62 before serving as input to a one-shot circuit 63. The output of the one-shot circuit 63 is directed to a front and rear driver circuit 64 which respectively drives a front and a rear motor 65. The power supply 66 supplies power to the sensor circuit 61, the pre-amplifier circuit 62, the one-shot circuit 63, the front and rear drive circuits 64 and to an astable vibration oscillator 67 which supplies oscillating voltage signals to the light bulbs 46. The light bulbs 46 thus operate in a flashing manner when the power supply switch 54 is switched on. The integrated circuit 6 is mounted on a printed circuit board fixed to the bottom face inside the stage assembly 1.

Figure 8:
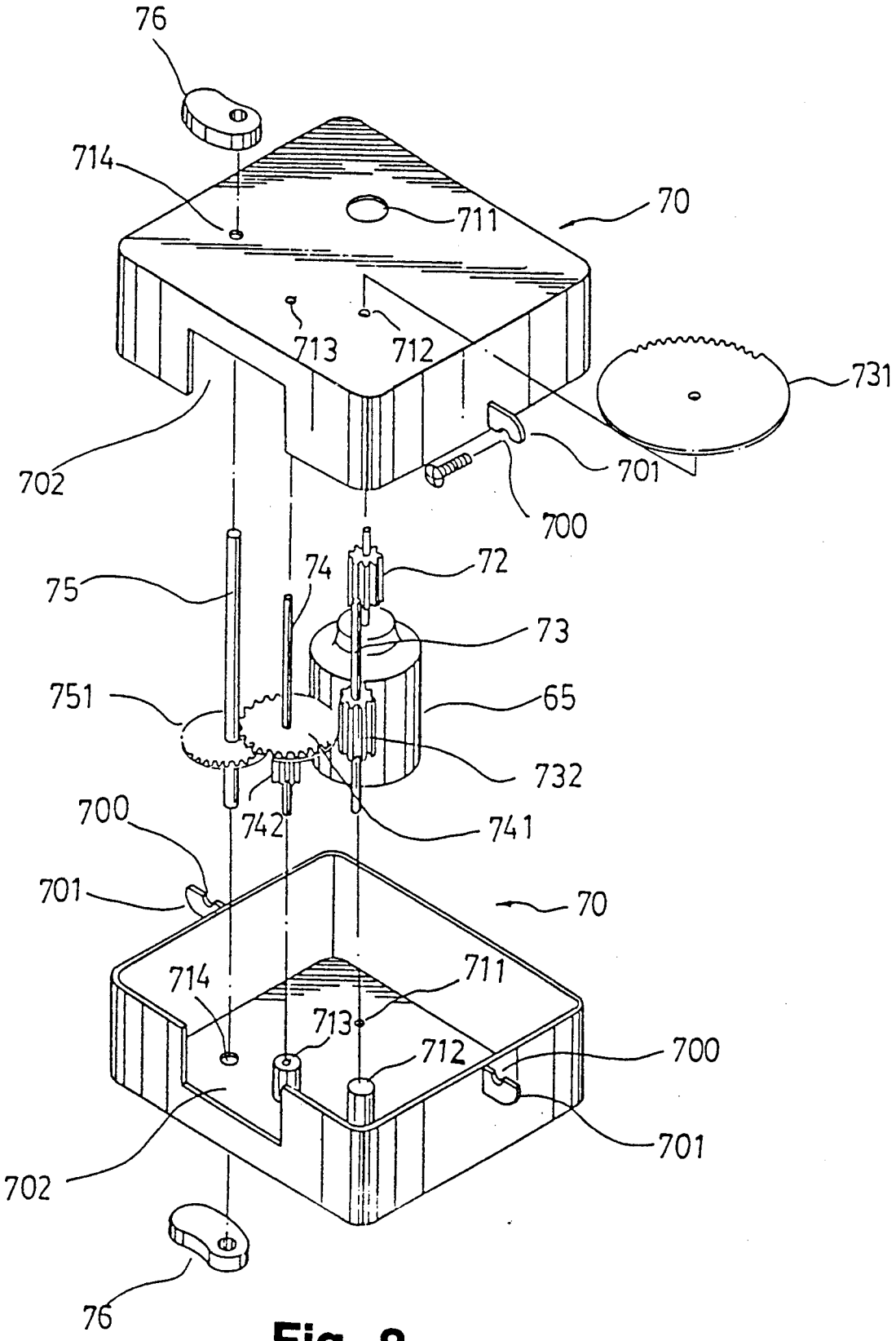
FIG. 8 is an exploded view of the front transmission mechanism of invention.

FIG. 8 is an exploded view of the front transmission mechanism 7. A gear casing 70 is formed as a rectangular hollow body and can be separated into two halves. A pair of oppositely disposed outwardly projecting ears 701, each of which has a semicircular notch 700, is formed near the peripheral edge of each half of the gear casing 70. When assembled, the semicircular notches 700 of the projecting ears 701 form a screw hole for receiving a screw member used in mounting the front transmission mechanism 7 to the bottom face of the stage assembly 1 (see FIG. 6(A).) The halves of the gear casing 70 further include a viewing notch 702 formed on a peripheral side for ease of repair of the front transmission mechanism 7, two receiving holes 711, 714 and two shaft receiving poles 712, 713.

The front transmission mechanism 7 further includes the front motor 65 having a small gear wheel 72 on an axle end and a front gear mechanism which includes an actuating axle 73 having a first gear wheel 731 and a second gear wheel 732, the first g ar wheel 731 being rotatably engaged to the small gear wheel 72 of the motor 65, an assisting axle 74 having a first gear wheel 741 and a second gear wheel 742, the first gear wheel 741 being rotatably engaged to the second gear wheel 732 of the actuating axle 73, and a transport axle 75 having a gear wheel 751 rotatably engaged to the second gear wheel 742 of the assisting axle 74. The two ends of the transport axle 75 project out of the receiving holes 714 of the gear casing 70 and are connected to curving eccentric wheels 76.

Figure 9A:
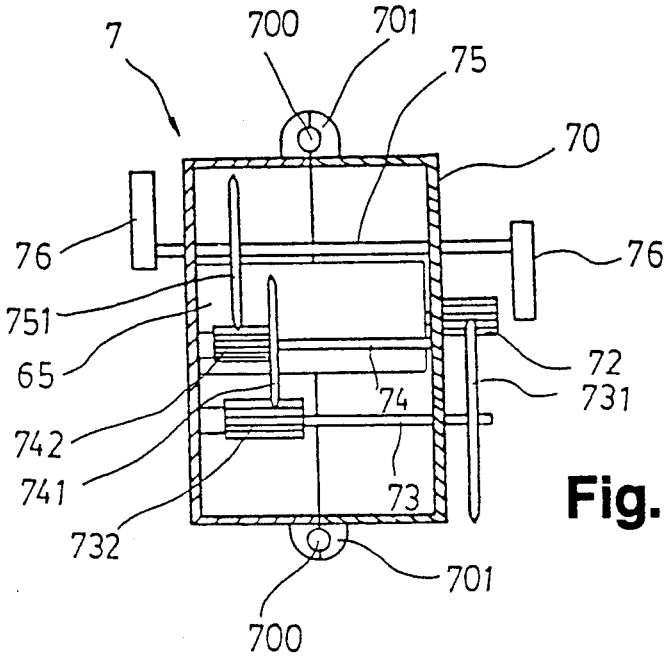
FIG. 9(A) is a diagrammatic view illustrating the operation of the front transmission mechanism shown in FIG. 8.

The operation of the front transmission mechanism is shown in FIG. 9(A). The output signal coming from the transducer 43 is fed into the integrated circuit 6 which causes the front motor 65 to rotate. The rotating motion is translated from the front motor 65 to the first gear wheel 731 of the actuating axle 73. The rotation of the actuating axle 73 rotates the first gear wheel 741 of the assisting axle 74. The rotation of the assisting axle 74 rotates the gear wheel 751 of the transport axle 75. The rotation of the transport axle 75 rotates the eccentric wheels 76.

Figure 9B:
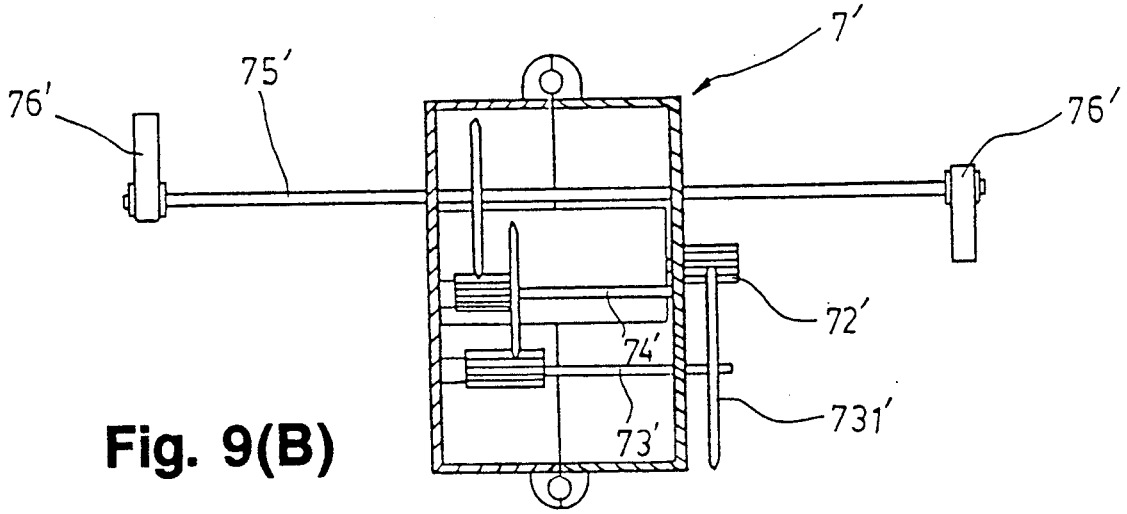
FIG. 9(B) is a diagrammatic view illustrating the operation of the rear transmission mechanism of the invention.

FIG. 9(B) shows the rear transmission mechanism 7' to have a structure and operation similar to that of the front transmission mechanism 7. The main differences are that the length of the transport axle 75' is longer and the shape of the eccentric wheels 76' is substantially circular compared to that of the eccentric wheels 76.

Figure 10:
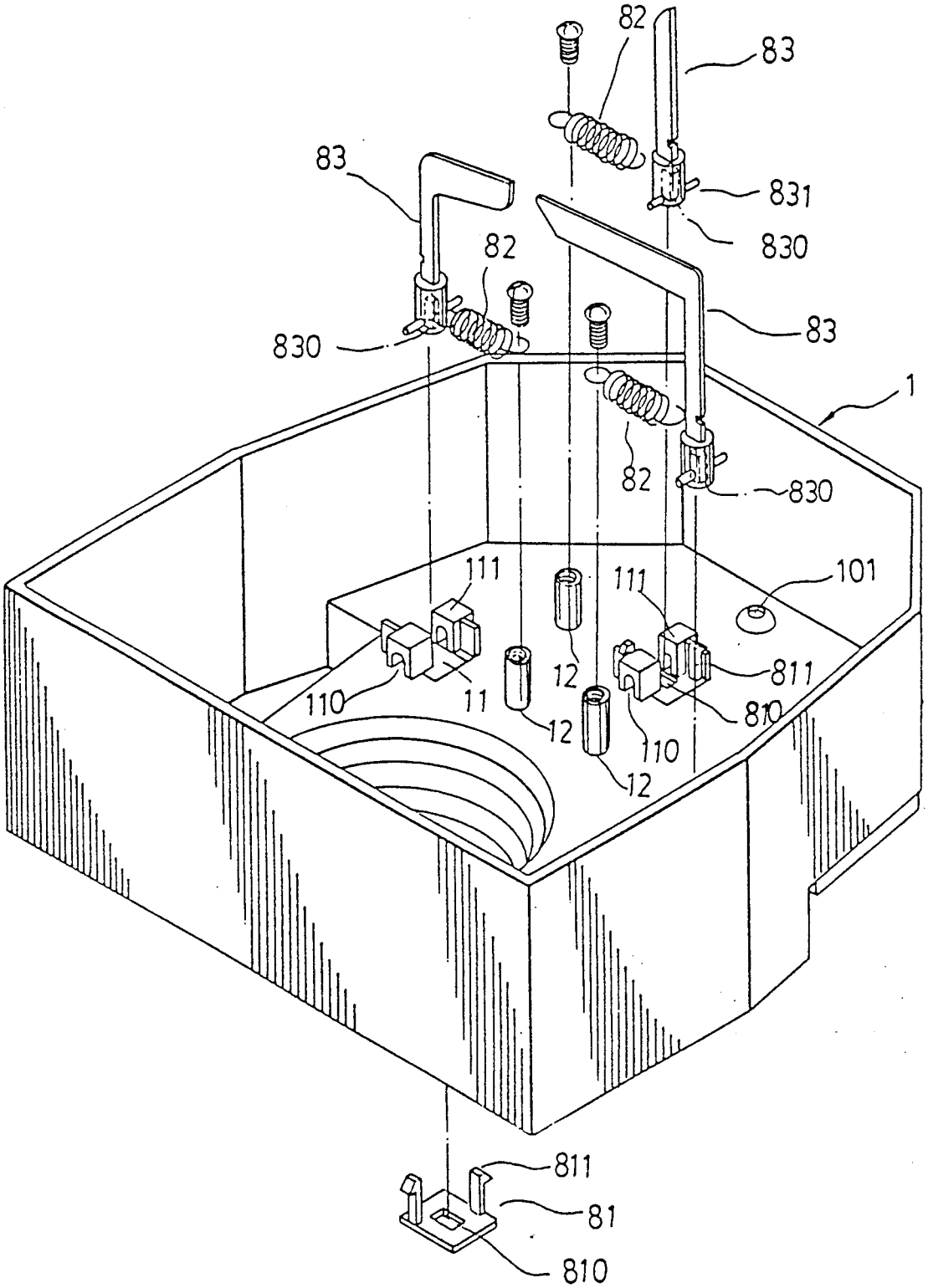
FIG. 10 is an exploded view of the front reciprocating mechanism of the invention.

An exploded view of the front reciprocating mechanism 8 is shown in FIG. 10. The stage assembly 1 is formed with three rectangular slots 11 and three threaded screw posts 12. A pair of mounting units 111, each having a transverse through-hole 110, is oppositely disposed on two sides of each rectangular slot 11. A slot cover 81 is mounted on top of each rectangular slot 11. The slot cover 81 has a rectangular opening 810 concentric with the rectangular slot 11. One end of the mounting support 38 of a toy frog 3 associated with the first group of toy frogs, projects through the rectangular opening 810. The slot cover 81 further includes a pair of symmetrical hook members 811 formed at the peripheral edge for engaging the stage assembly 1 at the rectangular slot 11. Three biasing members 82, such as spring units used in the preferred embodiment, each has a first hook end fixed to the screw receiving posts 12 by screws threaded to the same. The front reciprocating mechanism 8 further comprises three movement posts 83 having a shaft receiving post 830 at a first end for receiving the projecting end of the mounting support 38. A pair of oppositely disposed transverse mounting posts 831 is formed at the peripheral edge of each shaft receiving post 830 and is received by the transverse through-holes 110. Each movement post 83 includes a slit formed at a central section for receiving a second hook end of the biasing member 82. The second ends of the movement posts 83 have varying structures and are in contact with the periphery of one of the eccentric wheels 76. The rotation of the eccentric wheels 76 causes the movement posts 83 and the mounting support 38 of the toy frogs 3 associated with the first group of toy frogs to correspondingly move, thus causing the first group of toy frogs to move in a rocking manner (see FIG. 6(A).)

Referring to FIG. 6(A), the stage assembly 1 further includes a pair of rectangular pipe members 13 which receive the mounting supports 38 of the fourth and fifth toy frogs 3F, 3H. The mounting supports 38 of the fourth and fifth toy frogs 3F, 3H, and the pipe members 13 are rectangular in cross sectional configuration to prevent the mounting supports 38 from rotating relative to the pipe members 13. The rear reciprocating mechanism 8' includes a pair of plastic sleeve members 81' sleeved to the projecting ends of the mounting supports 38. The sleeve members 81' contact the periphery of the eccentric wheels 76' of the rear transmission mechanism 7' The rotation of the eccentric wheels 76' pushes the mounting supports 38 upward, causing the fourth and fifth toy frogs 3F, 3H, to correspondingly move.

When operating the preferred embodiment, the power supply switch 54 first is switched on. The light bulbs 46 start to operate in a flashing manner and the transducer 4 detects sound signals and sends electrical signals that serve as input to the integrated circuit 6. The integrated circuit 6 electrically connects the cell means 5 to the motor 65 when there is a sufficient electrical signal sent by the transducer 4. The front and rear motors 65 begin to move and their movements are translated to the front and rear transmission mechanisms 7, 7' and the front and rear reciprocating mechanisms 8, 8', which correspondingly allow the toy frogs 3 to move left and right, up and down. The heads of the toy frogs 3 are capable of movement and the mouths of the same can open and close. The toy frogs 3 thus give an impression that they are singing and performing before an audience.

Attention is directed to the connecting means between the hand portion 374 of the toy frogs 3 and the toy musical instruments and the connecting means between the foot portion 370 of the toy frogs 3 and the stage assembly 1. The connecting means can be achieved (a) by using double sided adhesion or heat sensitive adhesive, or (b) by using a combination of protruding studs and grooves.

When properly assembling the preferred embodiment, the toy frogs 3 are first mounted to the stage assembly 1, followed by the sound pick-up and stage lights assembly 4, the cell means 5, the integrated circuit 6, the front transmission mechanism 7, the rear transmission mechanism 7', the front reciprocating mechanism 8 and the rear reciprocating mechanism 8'. One end of the mounting supports 38 of the first, second, and third toy frogs 3A, 3B, 3C projects into the stage assembly 1 through the rectangular opening 810 and is received by the shaft receiving post 830 of the movement posts 83 of the front reciprocating mechanism 8. One end of the mounting supports 38 of the fourth and fifth toy frogs 3F, 3H projects inside the stage assembly 1, passing through the rectangular pipe members 13 and received by the sleeve members 81'. The fourth and fifth toy frogs 3F, 3H are not allowed to rotate relative to the pipe members 13.

When the electrical signals transmitted by the transducer 4 and received by the integrated circuit 6 and detected by the sensor circuit 61 are insufficient, the front and rear motors 65 will stop moving and the entire assembly stops. The toy assembly of this invention thus moves only when there is a sufficient electrical signal generated by the transducer 4. The speed of movement of the toy frogs 3 is thus controlled by the strength and frequency of the sound signals received by the transducer 4.

Various modifications of the foregoing description will occur to those skilled in the art without departing from the spirit or scope of this invention. For example, the toy frog FIGS. 3 could be formed as other animals or even human figures within the contemplated scope of this invention.

We claim:

1. A toy assembly, comprising:

a stage assembly formed as a hollow closed body with a top face and a bottom face, said top face being formed with a plurality of slots;

a plurality of movable toy figures mounted at said top face of said stage assembly, each of said plurality of movable toy figures having a mounting support with an end projecting inside said stage assembly through one of said slots, said toy figures being divided into a first and a second group;

a plurality of toy music instruments associated with said toy figures;

a sound pick-up unit including an electroacoustic transducer;

a stage lights assembly mounted to said top face of said stage assembly and having a plurality of light bulbs;

a cell means;

a power supply switch for said cell means;

an integrated circuit electrically connected to said electroacoustic transducer, said power supply switch, and said plurality of light bulbs; said integrated circuit supplying electric signal to said plurality of light bulbs in an oscillating manner to allow said plurality of light bulbs to operate in a flashing manner; said integrated circuit mounted inside said stage assembly;

a front motor being driven by said integrated circuit and having an axle end and a small gear wheel on said axis end;

a front transmission mechanism including a front gear mechanism rotatably engaged to said small gear wheel of said front motor, and a pair of curving eccentric wheels;

a front reciprocating mechanism receiving said projecting end of said mounting supports of said first group of said plurality of toy figures, and movably interacting with said eccentric wheels of said front transmission mechanism; said front reciprocating mechanism including a plurality of biasing members having a first end connected to said bottom face of said stage assembly and a plurality of movement posts, each having one end with a shaft receiving post for receiving said projecting end of said mounting supports of said first group of said plurality of toy figures, a central section connected to a second end of one of said plurality of biasing members, and a second end movably interacting with said eccentric wheels of said front gear mechanism;

a rear motor adapted to be driven by said integrated circuit and having an axle end and a small gear wheel on said axle end;

a rear transmission mechanism including a rear gear mechanism rotatably engaged to said small gear wheel of said rear motor, and a pair of substantially circular eccentric wheels; and a rear reciprocating mechanism receiving said projecting end of said mounting supports of said second group of said toy figures, and movably interacting with said eccentric wheels of said rear transmission mechanism;

whereby, when said power supply switch it switched on, said plurality of light bulbs start to flash, said transducer picks up sound signals and directs electric signals to said integrated circuit, said integrated circuit drives said front and rear motors to rotate, the rotation of said front and rear motors is translated to said front and rear transmission mechanism and to said front and rear reciprocating mechanisms, thereby causing said toy figures to move.

2. A toy assembly as claimed in claim 1, wherein each of said toy figures further comprises:

a two-part head portion having a hinged side, an openable side and a spring member to impart a resilient action on said openable side, said openable side acting as a mouth of each of said toy figures;

a hollow body portion connected to said two-part head portion and said mounting support of each of said toy figures;

a pair of upper limbs having a plurality of threaded beads;

a pair of lower limbs having a plurality of threaded beads;

whereby, said head portion and said upper and lower limb portions move when said mounting support is moved by said front and rear reciprocating mechanisms.

3. A toy assembly as claimed in claim 2, further comprising a toy microphone assembly mounted at said top end of said stage assembly and movably handled by a first toy figure.

4. A toy assembly as claimed in claim 3, wherein said plurality of toy musical instruments comprises:

a toy string instrument connected to said upper limbs of a second toy figure;

a toy wind instrument connected to said upper limbs of a third toy figure;

a toy keyboard instrument mounted at said top end of said stage assembly at the immediate front of a fourth toy figure; and a toy percussion instrument similarly mounted at said top end of said stage assembly at the immediate front of a fifth toy figure.

5. A toy assembly as claimed in claim 4, wherein said upper limbs of said second and said third toy figures are respectively connected to said toy string and said toy wind instruments by adhesive.

6. A toy assembly as claimed in claim 4, wherein said respectively connected to said toy string and said toy wind instruments by the engagement of protruding studs and grooves.

7. A toy assembly as claimed in claim 1, wherein said rear reciprocating mechanism comprises:

a plurality of inwardly extending pipe members formed on said top face of said stage assembly, said pipe members receiving said projecting end of said mounting supports of said second group of said plurality of said toy figures; and a plurality of sleeve members sleeved to said projecting end of said mounting supports of said second group of said plurality of said toy figures, said plurality of sleeve members being in contact with said eccentric wheels of said rear transmission mechanism;

whereby said mounting supports are pushed up by eccentric wheels of said rear transmission mechanism when said eccentric wheels rotate.

8. A toy assembly as claimed in claim 1 in which said toy figures are frogs.

9. A toy assembly, comprising:

a stage assembly having a top face formed with a plurality of slots;

a plurality of movable toy figures mounted at said top face, each of said plurality of movable toy figures having a mounting support with an end projecting into said stage assembly through one of said slots;

a sound pick-up unit including an electroacoustic transducer;

power supply means and means for activating said power supply means;

an integrated circuit mounted to said stage assembly and being electrically connected to said electroacoustic transducer and said power supply means;

at least one motor driven by said integrated circuit and having an axle end and a small gear wheel on said axle end;

a transmission mechanism including a front gear mechanism rotatably engaged to said small gear wheel, and a pair of curving eccentric wheels; and a reciprocating mechanism receiving said projecting end of said mounting supports of said plurality of toy figures, and movably interacting with said eccentric wheels of said transmission mechanism; said reciprocating mechanism including a plurality of biasing members having a first end connected to a bottom end of said stage assembly and a plurality of movement posts, each having one end with a shaft receiving post for receiving said projecting end of said mounting supports of said toy figures, a central section connected to a second end of one of said biasing members, and a second end movably interacting with said eccentric wheels of said gear mechanism;

whereby, when said power supply is activated, said transducer detects sound signals and directs electric signals to said integrated circuit, said integrated circuit drives said motor to rotate, the rotation of said motor is translated to said transmission mechanism and to said reciprocating mechanism, thereby causing said figures to move.

10. A toy assembly as claimed in claim 9, wherein each of said toy figures further comprises:

a two-part head portion having a hinged side, an openable side and a spring member to impart a resilient action on said openable side, said openable side acting as a mouth of each of said toy figures;

a hollow body portion connected to said two-part head portion and said mounting support of each of said toy figures;

a pair of upper limbs having a plurality of threaded beads;

a pair of lower limbs having a plurality of threaded beads;

whereby, said head portion and said upper and lower limb portions move when said mounting support is moved by said reciprocating mechanism.

11. A toy assembly as claimed in claim 10, further comprising a toy microphone assembly mounted on said stage assembly and movably handled by a first toy figure.

12. A toy assembly as claimed in claim 11, including a plurality of toy musical instruments associated with said toy figures, said toy musical instruments including:

a toy spring instrument connected to said upper limbs of a second toy figure;

a toy wind instrument connected to said upper limbs of a third toy figure;

a toy keyboard instrument mounted on said stage assembly at the immediate front of a fourth toy figure; and a toy percussion instrument similarly mounted on said stage assembly at the immediate front of a fifth toy figure.

13. A toy assembly as claimed in claim 12, wherein said upper limbs of said second and said third toy figures are respectively connected to said toy string and said toy wind instruments by adhesive.

14. A toy assembly as claimed in claim 12, wherein said upper limbs of said second and said third toy figures are respectively connected to said toy string and said toy wind instruments by the engagement of protruding studs and grooves.

15. A toy assembly as claimed in claim 11, wherein there is a second motor and a second reciprocating mechanism and said second reciprocating mechanism comprises:

a plurality of inwardly extending pipe members formed on said stage assembly, said pipe members receiving said projecting end of said mounting supports of said toy figures; and a plurality of sleeve members sleeved to said projecting end of said mounting supports of said toy figures, said plurality of sleeve members being in contact with said eccentric wheels of said second transmission mechanism;

whereby, said mounting supports are pushed up by said eccentric wheels of said second transmission mechanism when said eccentric wheels rotate.

* * * * *

UNITED STATES PATENT AND TRADEMARK OFFICE

CERTIFICATE OF CORRECTION

PATENT NO. : 5,040,319

DATED : August 20, 1991

INVENTOR(S) : Kuang Chuan Wang and Arthur Yun Ping Wang

It is certified that error appears in the above-identified patent and that said Letters Patent is hereby corrected as shown below:

Column 2, line 3, change "on light" to --on, light--;

line 28, change "constructed to" to --constructed according to--;

line 32, change "figure according" to --figure constructed according--;

line 34, change "assembly according" to --assembly constructed according--;

line 36, change "instrument according" to --instrument constructed according--;

line 40, change "5(B) front" to --5(B) is a front--;

line 41, change "of the and" to --of the sound pick-up and--;

line 43, change "of the in with" to --of the invention with--;

line 45, change "of the assembly" to --of the stage assembly--;

line 46, change "Figure 7 a" to --Figure 7 is a--;

UNITED STATES PATENT AND TRADEMARK OFFICE

CERTIFICATE OF CORRECTION

PATENT NO. : 5,040,319

DATED : August 20, 1991

INVENTOR(S) : Kuang Chuan Wang and Arthur Yun Ping Wang

It is certified that error appears in the above-identified patent and that said Letters Patent is hereby corrected as shown below:

line 47, change "integrated of the" to --integrated circuit of the--;

line 49, change "of invention" to --of the invention--;

Column 3, line 4, change "instrument A third" to --instrument. A third--;

Column 4, line 7, change "36" to --361--;

Column 6, line 25, change "side Of the" to --side of the--;

Column 7, line 15, change "the first g ar" to --the first gear--;

Column 8, line 22, change "7' The" to --7'. The--;

Column 9, line 41, change "signal" to --signals--;

Column 10, line 13, change "switch it switched" to --switch is switched--;

UNITED STATES PATENT AND TRADEMARK OFFICE

CERTIFICATE OF CORRECTION

PATENT NO. : 5,040,319

DATED : August 20, 1991

INVENTOR(S) : Kuang Chuan Wang and Arthur Yun PingWang

It is certified that error appears in the above-identified patent and that said Letters Patent is hereby corrected as shown below:

Column 10, line 61, after "wherein said" insert --upper limbs of said second and said third toy figures are--.

Signed and Sealed this

Twenty-fourth Day of December, 1991

*Attest:*

HARRY F. MANBECK, JR.

*Attesting Officer*

*Commissioner of Patents and Trademarks*